US007079783B2

(12) United States Patent
Yokoi

(10) Patent No.: US 7,079,783 B2
(45) Date of Patent: Jul. 18, 2006

(54) DEVELOPING CARTRIDGE DETACHABLE FROM IMAGE FORMING DEVICE

(75) Inventor: Katsuyuki Yokoi, Iwakura (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/627,624

(22) Filed: Jul. 28, 2003

(65) Prior Publication Data

US 2004/0028424 A1 Feb. 12, 2004

(30) Foreign Application Priority Data

Aug. 9, 2002 (JP) ..... 2002-234165

(51) Int. Cl.
*G03G 15/00* (2006.01)

(52) U.S. Cl. ..... 399/90; 399/111; 399/119

(58) Field of Classification Search ..... 347/115, 347/138, 152; 399/90, 111, 112, 113, 119, 399/223, 226, 227
See application file for complete search history.

(56) References Cited

U.S. PATENT DOCUMENTS

| | | | |
|---|---|---|---|
| 4,778,231 A | 10/1988 | Seidler et al. | |
| 5,761,589 A | 6/1998 | Kido et al. | |
| 6,782,219 B1 * | 8/2004 | Yoshino et al. | 399/90 |

FOREIGN PATENT DOCUMENTS

| | | |
|---|---|---|
| JP | S62-500694 | 3/1987 |
| JP | H04-051256 | 2/1992 |
| JP | H04-55059 | 5/1992 |
| JP | H07-169449 | 7/1995 |
| JP | H08-160840 | 6/1996 |
| JP | A 8-248767 | 9/1996 |
| JP | H09-044057 | 2/1997 |
| JP | H10-123915 | 5/1998 |
| JP | H11-305629 | 11/1999 |
| JP | 2000-132064 | 5/2000 |
| WO | WO 86/02206 | 4/1986 |

* cited by examiner

*Primary Examiner*—Hoang Ngo
(74) *Attorney, Agent, or Firm*—Oliff & Berridge, PLC

(57) ABSTRACT

A toner cartridge for use in a printer includes a developing roller and an electrode. The toner cartridge is mountable in the printer by moving in a mounting direction and removable from the printer by moving in a removal direction. The developer roller supplies toner to a photosensitive member of the printer. The electrode is for electrically connecting with a bias supply electrode of the printer to supply a bias to the developing roller. The electrode moves, in a direction from outside the housing toward the interior of the housing and orthogonal to the mounting direction and the removal direction, under contact with the printer while the developing cartridge is being mounted in the printer. The electrode is electrically connected with the bias supply electrode of the printer while the developing cartridge is mounted in the printer.

45 Claims, 11 Drawing Sheets

DEVELOPING CARTRIDGE DETACHABLE FROM IMAGE FORMING DEVICE

BACKGROUND OF THE INVENTION

1. Field of the Invention

The present invention relates to a developing cartridge that is freely mountable in and removable from an image forming device.

2. Description of Related Art

Color laser printers are capable of forming images in full color. A color laser printer is provided with a plurality of different developing cartridges, each holding a different color of toner. The developing cartridges are freely mountable in and removable from the laser printer.

Each developing cartridge includes a housing, a developing roller, a layer thickness regulating blade, and a supply roller. The housing is formed with a toner holding chamber that holds the toner in the color that corresponds to the developing cartridge. The developing roller, the layer thickness regulating blade, and the supply roller are housed in the housing. The toner contained in the toner holding chamber is supplied to the developing roller by the supply roller. The toner supplied to the developing roller passes between the developing roller and the layer thickness regulating blade and is regulated to a thin layer of uniform thickness on the surface of the developing roller.

The color laser printer further includes a photosensitive member and an exposure unit. The photosensitive member is formed with a photosensitive layer at its outer surface. The exposure unit selectively exposes the photosensitive layer to laser light to form an electrostatic latent image on the photosensitive member. When the developing cartridges are mounted in the casing of the color laser printer, the developing roller of each developing cartridge is disposed in confrontation with photosensitive member so that the toner borne on the surface of the developing roller develops the electrostatic latent image into a visible toner image.

The visible toner images in each different color of toner are transferred on top of each other onto a sheet to form a color image on the sheet.

Leaf-spring type electrodes are provided on the casing of the laser printer at positions that correspond to the developing cartridges. Each leaf-spring type electrode is connected to a high-voltage source that is housed within the casing and applies developing bias to the developing roller of the corresponding developing cartridge. That is, each leaf-spring type electrode abuts against the end of the roller shaft of the corresponding developing roller, that is, while the developing cartridge is fully mounted in the casing of the laser printer.

When one of the developing cartridges is mounted into the casing of the laser printer, the end of the roller shaft moves into confrontation with and presses against the corresponding leaf-spring type electrode. This brings the roller shaft into electrical connection with the high-voltage source so that the developing bias from the high-voltage source can be applied to the developing roller. At this time, the leaf-spring type electrode resiliently bends under the pressing force of the roller shaft. The resultant urging force form the leaf-spring type electrode maintains good contact between the leaf-spring type electrode and the roller shaft.

SUMMARY OF THE INVENTION

The leaf-spring electrodes can permanently deform under the pressing force of the roller shafts. When an electrode deforms excessively, contact between the electrode and the end of the roller shaft can become defective so that the developing bias is not properly applied to the developing roller. However, the user cannot easily repair such a defective electrode because the electrodes are disposed within the casing of the laser printer. The user must request the printer manufacturer to repair the electrode. This can be a troublesome experience. The same problem can be found in a variety of different removable members that are used in laser printers or other image forming devices.

It is an objective of the present invention to provide a removable member and an image forming device wherein problems with electrodes or other members for establishing an electrical connection between the removable member and the image forming device can be easily remedied.

In order to achieve the above-described objective, detachable member according to the present invention is for use in an image forming device including an electrical connection section and includes a housing and a conductive member. The housing is mountable in the image forming device by moving in a mounting direction and removable from the image forming device by moving in a removal direction. The housing substantially encompassing an interior. The conductive member is connected to the housing. The conductive member moves in a contact movement direction under contact by the electrical connection section while the housing is being mounted in the image forming device and electrically connects with the electrical connection section of the image forming device while the housing is mounted in the image forming device. The contact movement direction is a direction from outside the housing toward the interior of the housing and orthogonal to the mounting direction and the removal direction.

An image forming device according to the present invention includes a mounting section and a detachable member. The mounting section includes an electrical connection section. The detachable member is mountable in the mounting section by moving in a mounting direction and removable from the mounting section by moving in a removal direction. The detachable member includes a housing and a conductive member. The housing substantially encompasses an interior. The conductive member is connected to the housing. The conductive member moves in a contact movement direction under contact by the electrical connection section while the housing is being mounted in the mounting section and electrically connects with the electrical connection section while the housing is mounted in the mounting section. The contact movement direction is from outside the housing toward the interior of the housing and orthogonal to the mounting direction and the removal direction.

BRIEF DESCRIPTION OF THE DRAWINGS

The above and other objects, features and advantages of the invention will become more apparent from reading the following description of embodiments taken in connection with the accompanying drawings in which.

DETAILED DESCRIPTION OF THE EMBODIMENTS

Next, a color laser printer 1 according to an embodiment of the present invention will be described with reference to FIGS. 1 to 6.

Figure 1:
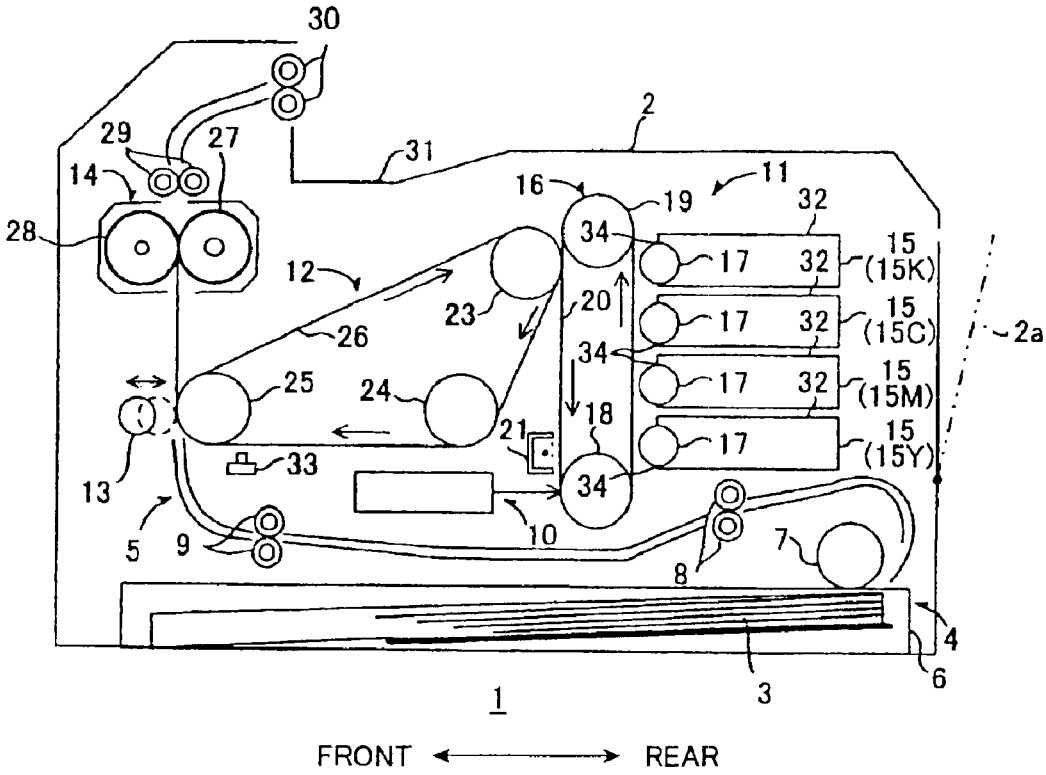
FIG. 1 is a cross-sectional view showing a color laser printer according to an embodiment of the present invention.

As shown in FIG. 1, the laser printer 1 includes a casing 2 and various components, such as a feeder 4 and an image forming unit 5, housed in the casing 2. The feeder 4 is for supplying sheets 3 to the image forming unit 5. The image forming unit 5 forms images on the supplied sheets 3. In the following explanation, the "front" of the color printer 1 will refer to the left side of FIG. 1 and the "rear" of the color printer 1 will refer to the right side of FIG. 1.

A rear cover 2*a* is provided pivotably about a hinge provided on the rear wall of the casing 2. The rear cover 2*a* can be freely pivoted open and closed about the hinge. The open position of the rear cover 2*a* is indicated in two-dot chain line in FIG. 1.

The feeder 4 includes a sheet-feed tray 6, a sheet-supply roller 7, transport rollers 8, and registration rollers 9. The sheet-feed tray 6 is removable from the housing and holds a stack of sheets 3. The sheet-supply roller 7 is provided at the rear side of the sheet-feed tray 6. The transport rollers 8 are provided downstream from the sheet-supply roller 7 with respect to the transport direction of the sheets 3. The registration rollers 9 is provided downstream from the transport rollers 8 with respect to the transport direction of the sheets 3. The sheet-supply roller 7 rotates to feed out the uppermost sheet in the stack in the sheet-feed tray 6. After the registration rollers 9 perform a registration operation on the sheet 3, the sheet 3 is transported to a transfer position of the image forming unit 5. The transfer position is the position between a third intermediate transfer member roller 25 and a transfer roller 13 to be described later.

The image forming unit 5 includes a scanner unit 10, a process section 11, an intermediate transfer belt mechanism 12, the transfer roller 13, and a fixing unit 14.

The scanner unit 10 is positioned in the center of the casing 2 and below the intermediate transfer belt mechanism 12. Although not shown in the drawings, the scanner unit 10 includes a laser emitting portion, a polygonal mirror, lenses, and reflection mirrors. The laser emitting portion emits a laser beam based on image data. The laser beam is reflected off or passes through the polygon mirror, the lenses, and the reflection mirrors so as to be scanned at a high speed on the surface of a photosensitive belt 20 of the intermediate transfer belt mechanism 12.

The process section 11 includes four developing cartridges 15 and a photosensitive belt mechanism 16.

The four developing cartridges 15 are disposed at the rear portion of the casing 2 and include developing cartridges 15C, 15M, 15Y, and 15K, which are aligned vertically separated by a predetermined distance from each other. The developing cartridges 15C, 15M, 15Y, and 15K each includes a toner holding chamber that stores toner in the corresponding color of cyan (C), magenta (M), yellow (Y), and black (BK).

The developing cartridges 15 each include a housing 32, a developing roller 17 and, although not shown in the drawings, a layer thickness regulating blade, a supply roller, and a toner holding section.

Figure 16:
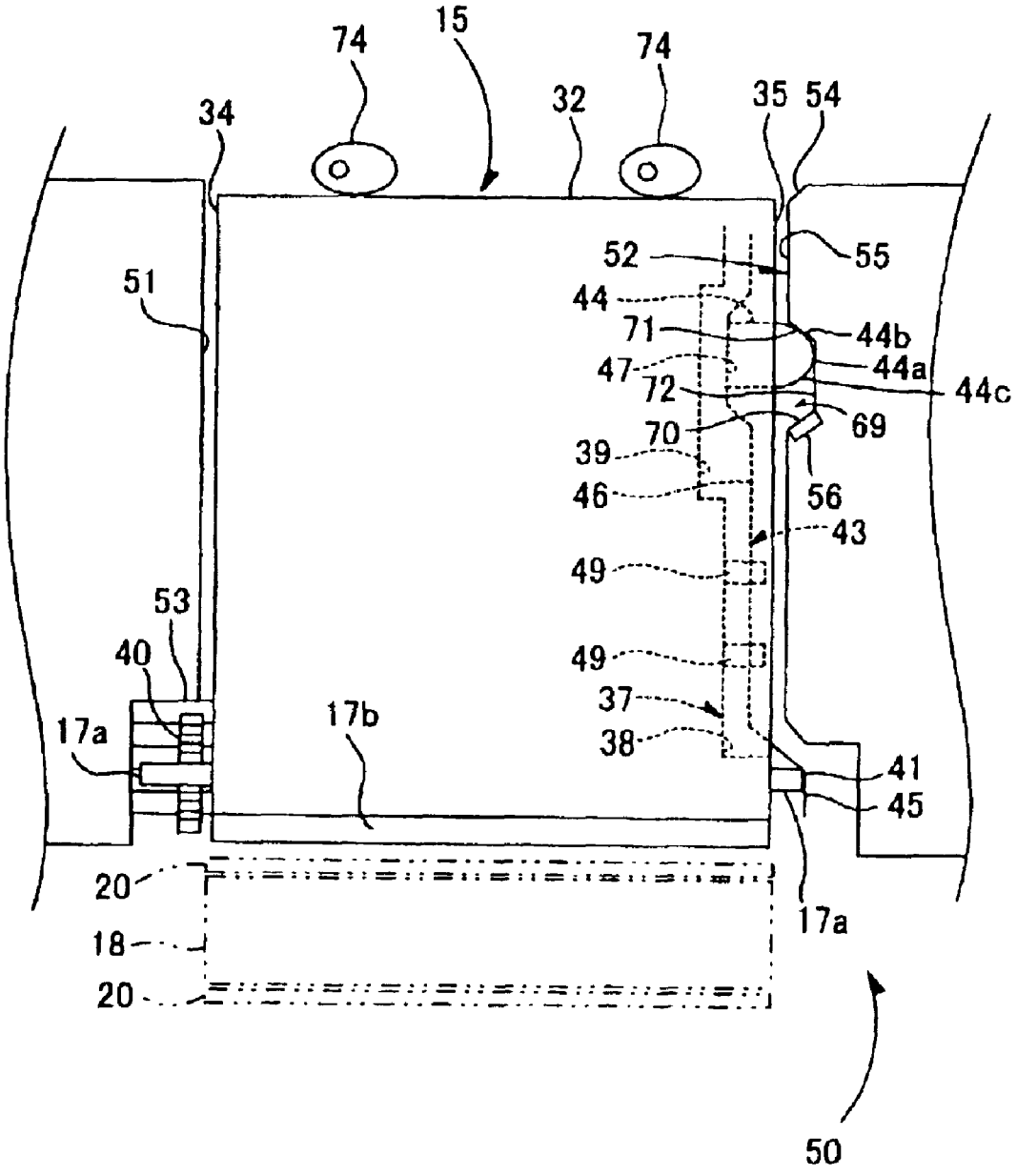
FIG. 16 is a plan view showing the modification of FIG. 14 wherein the developing cartridge is in a separated position.
Figure 17:
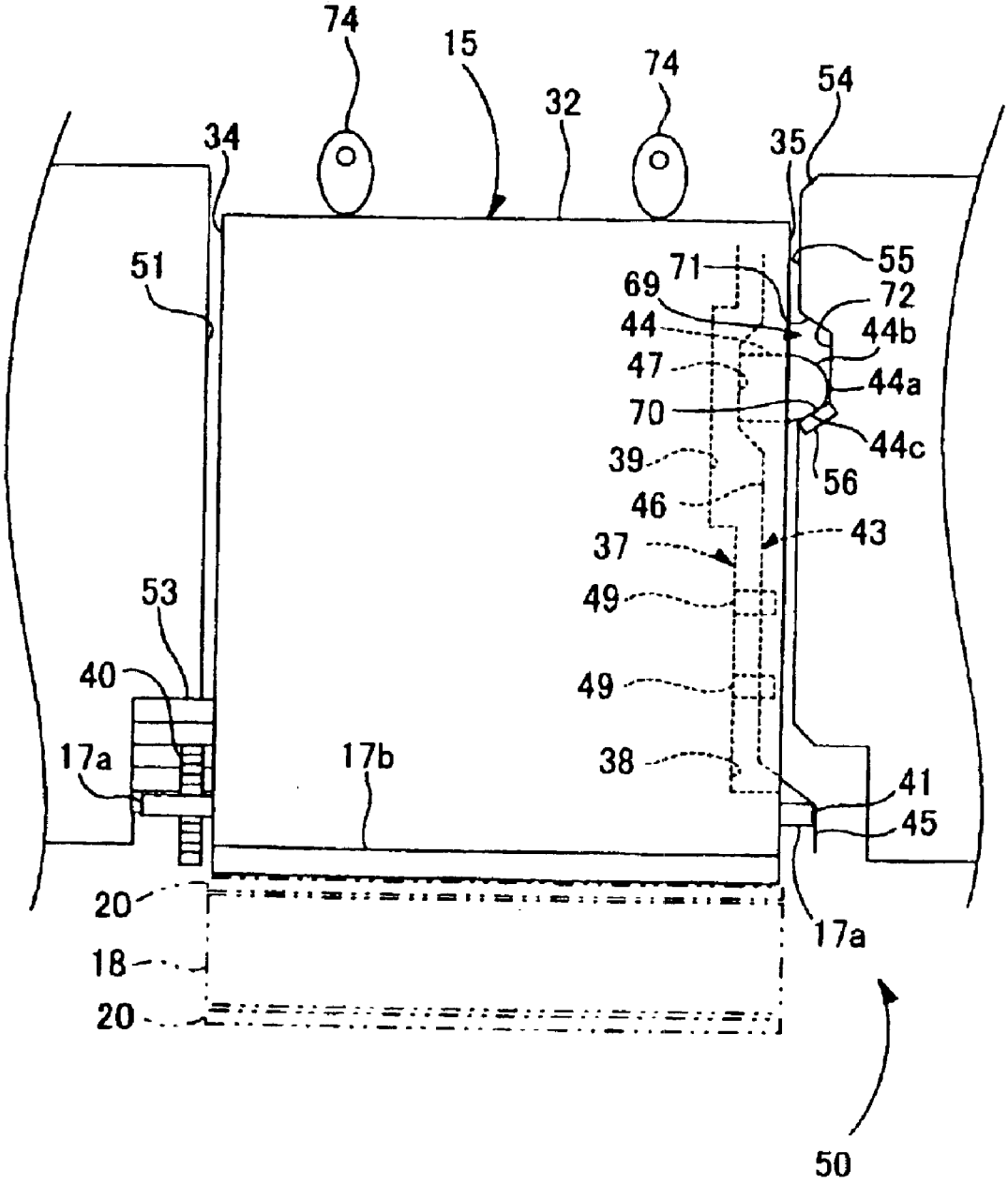
FIG. 17 is a plan view showing the modification of FIG. 14 wherein the developing cartridge is in a contact position.

A contact/separation mechanism is provided for moving each of the developing cartridges 15 independently horizontally forward and backward between a contact position in contact with the photosensitive belt 20 and a separated position out of contact with the photosensitive belt 20. The contact/separation mechanism is the same as shown in the modification of FIGS. 16 and 17 and so will be explained with reference to FIGS. 16 and 17. That is, cams 74 are provided for each of the developing cartridges 15 to move the developing cartridges 15 horizontally forward and backward between the contact position and the separated position. As shown in FIG. 17, the developing roller 17 contacts the photosensitive belt 20 while in the contact position. As shown in FIG. 16, the developing roller 17 is separated from the photosensitive belt 20 while in the separated position. Although not shown in the drawings, a solenoid is provided for driving the cams 74.

Returning to FIG. 1, each of the developing cartridges 15 can be separately removed from the casing 2 by pulling the developing cartridge 15 horizontally rearward while the rear cover 2*a* is open. This enables the developing cartridges 15 to be replaced as needed.

According to the present embodiment, the developing cartridges 15 hold a positively-charging, non-magnetic, single-component polymer toner in the corresponding color of cyan (C), magenta (M), yellow (Y), and black (BK). The polymer toner can be made by copolymerizing a polymerizing monomer using a well-known polymerization method such as suspension polymerization or emulsion polymerization. Particles of the polymerized toner are spherical and so have extremely good fluidity.

Figure 2:
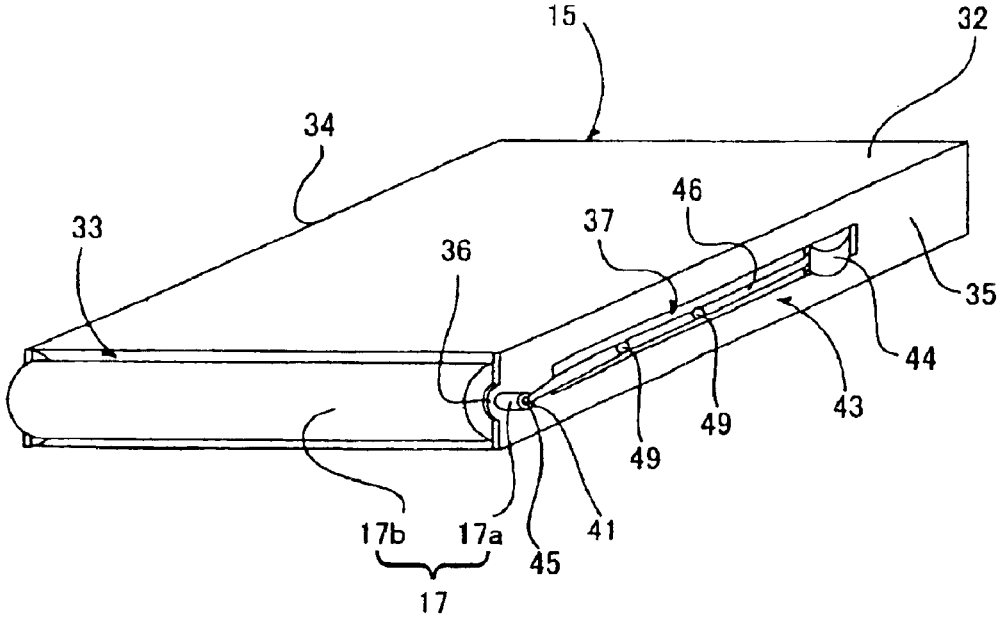
FIG. 2 is a perspective view showing a developing cartridge of the color laser printer of FIG. 1.

As shown in FIG. 2, each developing roller 17 includes a roller shaft 17*a* and a roller section 17*b*. The roller shaft 17*a* is made from metal. The roller section 17*b* is made from a conductive rubber material in a tube shape and covers the roller shaft 17*a*. Each developing roller 17 is freely rotatably supported in an opening at the front end of the housing 32 of the corresponding developing cartridge 15. Although not shown in the drawings, a motor is provided within the casing 2 and supplies drive force for driving each developing roller 17 to rotate. Although not shown in the drawings, a high-voltage source is provided in the casing 2 for applying a developing bias to each of the developing rollers 17 during development operations.

The supply roller rotates to supply toner held in the toner holding portion to the developing roller 17. Friction between the supply roller and the developing roller 17 triboelectrify the toner to a positive-polarity charge. Next, rotation of the developing roller 17 moves the toner borne on the surface of the developing roller 17 in between the layer thickness regulating blade and the developing roller 17 so that the toner is regulated to a thin layer of uniform thickness.

The photosensitive belt mechanism 16 is located in confrontation with the four developing cartridges 15 at a position in front of the four developing cartridges 15. The photosensitive belt mechanism 16 includes a first photosensitive belt roller 18, a second photosensitive belt roller 19, the photosensitive belt 20, and a scorotron charge unit 21.

The first photosensitive belt roller 18 is located in confrontation with the yellow developing cartridge 15C, which is the lowest of the developing cartridges 15. The second photosensitive belt roller 19 is located in confrontation with the black developing cartridge 15K, which is the uppermost of the developing cartridges 15. The photosensitive belt 20 is wrapped around the first photosensitive belt roller 18 and the second photosensitive belt roller 19. The photosensitive belt 20 is an endless belt made from a resin, such as polyethylene terephthalate (PET). The surface of the photosensitive belt 20 is formed with an aluminum deposition layer. The photosensitive belt 20 is formed with an organic photosensitive layer that has a positively charging nature.

Although not shown in the drawings, a motor is provided for driving the second photosensitive belt roller 19 to rotate. The first photosensitive belt roller 18 follows rotation of the second photosensitive belt roller 19. As the first photosensitive belt roller 18 and the second photosensitive belt roller 19 rotate, the photosensitive belt 20 moves in a counterclockwise direction around the outer periphery of the first photosensitive belt roller 18 and the second photosensitive belt roller 19.

The scorotron charge unit 21 is disposed adjacent to the photosensitive belt 20 at a position that is near the first photosensitive belt roller 18. In more detail, the scorotron charge unit 21 is located at a position that, with respect to movement direction of the photosensitive belt 20, is downstream from the second photosensitive belt roller 19 and upstream from where the scanner unit 10 exposes the photosensitive belt 20 with laser light. The scorotron charge unit 21 is separated from the photosensitive belt 20 by a predetermined distance. The scorotron charge unit 21 generates a corona discharge from a charge wire made from, for example, tungsten steel to charge the surface of the photosensitive belt 20 to a uniform charge.

As the photosensitive drum 27 rotates, the surface of the photosensitive drum 27 is first charged uniformly to a positive charge by the scorotron charge unit 29, and then exposed by the high-speed scanning laser beam from the scanner unit 16 to form an electrostatic latent image based on image data.

As the developing roller 17 of the particular developing cartridge 15 presently being operated confronts and contacts the photosensitive belt 20, rotation of the developing roller 17 supplies positively-charged toner that is borne on the developing roller 17 to the static-electric latent image formed on the surface of the photosensitive belt 20. At this time, the toner is selectively borne on only portions of the photosensitive belt 20 that were exposed by the laser beam from the scanner unit 10. That is, when the laser beam exposes portions of the uniformly positively charged surface of the photosensitive belt 20, the electric potential drops at the exposed portions. The supplied toner is selectively transferred to only the exposed portions, thereby developing the electrostatic latent image into a visible toner image. In this way, an inverse development operation is performed. By this operation, a monochrome toner image is formed on the photosensitive belt 20 from toner held in the particular developing cartridge 15 that is presently being used to develop images.

The intermediate transfer belt mechanism 12 includes a first intermediate transfer belt roller 23, a second intermediate transfer belt roller 24, the third intermediate transfer member roller 25, and an intermediate transfer belt 26.

The first intermediate transfer belt roller 23 is disposed in substantial confrontation with the second photosensitive belt roller 19, with the photosensitive belt 22 and the intermediate transfer belt 26 interposed therebetween. The second intermediate transfer belt roller 24 is disposed below the first intermediate transfer belt roller 23 and to the rear of the third intermediate transfer member roller 25. The third intermediate transfer belt roller 25 is disposed diagonally from (below and to the front of) the first intermediate transfer belt roller 23. The third intermediate transfer belt roller 25 is further disposed in confrontation with the transfer roller 13, with the intermediate transfer belt 26 interposed between the third intermediate transfer member roller 25 and the transfer roller 13. The intermediate transfer belt 26 is an endless belt made from a conductive resin, such as polyimide or polycarbonate, which is dispersed with conductive particles, such as carbon. The intermediate transfer belt 26 is wound around the intermediate transfer belt rollers 23 to 25 and forms a substantially triangular shape accordingly.

The first intermediate transfer belt roller 23 is driven to rotate by drive force transmitted from a motor (not shown). The second intermediate transfer belt roller 24 and the third intermediate transfer member roller 25 follow rotation of the first intermediate transfer belt roller 23. As a result, the intermediate transfer belt 26 moves clockwise around the outer periphery of the first intermediate transfer belt roller 23, the second intermediate transfer belt roller 24, and the third intermediate transfer member roller 25.

The portion of the intermediate transfer belt 26 at the first intermediate transfer belt roller 23 contacts the photosensitive belt 20. Accordingly, a nip is formed between the intermediate transfer belt 26 and the photosensitive belt 20 where they contact. The intermediate transfer belt 26 and the photosensitive belt 20 move in the same direction at the nip. Also, the first intermediate transfer belt roller 23 is applied with a bias that moves toner from the photosensitive belt 20 to the intermediate transfer belt 26.

When the monochrome toner image borne on the photosensitive belt 20 moves into confrontation with the intermediate transfer belt 26, the toner image is transferred to the intermediate transfer belt 26 by the bias applied to the first intermediate transfer belt roller 23. In similar operations, monochrome images are formed successively on the photosensitive belt 20 by each of the developing cartridges 15, and transferred one on top of each other onto the intermediate transfer belt 26, thereby forming a color image on the intermediate transfer belt 26.

Described in more detail, the solenoid (not shown) drives the cams 74 of the yellow developing cartridge 15Y to rotate so that the yellow developing cartridge 15Y moves horizontally into the contact position shown in FIG. 17. As a result, the developing roller 17 of the yellow developing cartridge 15Y contacts the photosensitive belt 20, which is formed with an electrostatic latent image that corresponds to the yellow portion of the full color image to be printed. At the same time, the cams 74 for the other developing cartridges 15 (15M, 15C, and 15K) are driven to move the other developing cartridges 15 horizontally into the separated position shown in FIG. 16. As a result, first a yellow visible toner image is formed on the photosensitive belt 20 from the yellow toner that fills the yellow developing cartridge 15Y. Next, the yellow visible toner image formed on the photosensitive belt 20 is transferred onto the intermediate transfer belt 26 while movement of the photosensitive belt 20 moves the photosensitive belt 20 serially into confrontation with the intermediate transfer belt 26.

In a similar manner, the solenoid (not shown) drives the cams 74 of the magenta developing cartridge 15M to rotate so that the magenta developing cartridge 15M moves horizontally into the contact position shown in FIG. 17. As a result, the developing roller 17 of the magenta developing cartridge 15M contacts the photosensitive belt 20, which is formed with an electrostatic latent image that corresponds to the magenta portion of the full color image to be printed. At the same time, the cams 74 for the other developing cartridges 15 (15Y, 15C, and 15K) are driven to move the other developing cartridges 15 horizontally into the separated position shown in FIG. 16. As a result, a magenta visible toner image is formed on the photosensitive belt 20 from the magenta toner that fills the magenta developing cartridge 15M. Next, the magenta visible toner image formed on the photosensitive belt 20 is transferred onto the yellow toner image that is on the intermediate transfer belt 26 while movement of the photosensitive belt 20 moves the photosensitive belt 20 serially into confrontation with the intermediate transfer belt 26. In this way, the magenta toner image is superimposed on the yellow toner image on the intermediate transfer belt 26.

Similar operations are repeated for the cyan toner held in the cyan developing cartridge 15C and for the black toner held in the developing cartridge 15K until a full-color image is formed on the intermediate transfer belt 26.

The transfer roller 13 is rotatably disposed in substantial confrontation with the third intermediate transfer member roller 25 through the intermediate transfer belt 26. Also, the transfer roller 13 is driven selectively into and out of contact with the intermediate transfer belt 26. That is, the transfer roller 13 is separated from the intermediate transfer belt 26 while the different monochrome images are being transferred one at a time onto the intermediate transfer belt 26, but moved into contact with the surface of the intermediate transfer belt 26 while the color image is being transferred to a sheet 3. Further, the transfer roller 15 is applied with a predetermined transfer bias by a transfer bias while the color image is being transferred to a sheet 3.

While a sheet 3 passes between the transfer roller 13 and the intermediate transfer belt 26, the full-color image formed on the intermediate transfer belt 26 is transferred onto the sheet 3 by operation of the transfer roller 13. It should be noted that the position where the transfer roller 13 contacts the intermediate transfer belt 26 is referred to as the transfer position.

The fixing unit 14 is disposed above the transfer roller 13 and includes a thermal roller 27, a pressing roller 28, and a pair of transport rollers 29. The pressing roller 28 presses against the thermal roller 27. The transport rollers 29 are located downstream from the thermal roller 27 and the pressing roller 28, that is, with respect to the direction of sheet transport. The thermal roller 27 is configured from an internal metal layer, an external silicone rubber layer, and a halogen lamp for heating up the metal and silicone rubber layers. At the transfer position of the image forming unit 5, the color image that was transferred onto the sheet 3 is thermally fixed onto the sheet 3 while the sheet 3 passes between the thermal roller 27 and the pressing roller 28.

The transport rollers 29 transport the sheet 3 with the color image fixed thereto to a pair of discharge rollers 30. The discharge rollers 30 discharge the sheet 3 onto a discharge tray 31 formed at the top of the casing 2.

Next, the developing cartridges 15 provided in each of the process sections 11 will be described in greater detail with reference to FIGS. 2 to 6. All of the developing cartridges 15 have substantially the same configuration, with the exception of the toner contained therein. Therefore, the following explanation will be limited to a generic developing cartridge 15 unless mentioned otherwise.

As shown in FIG. 2, the housing 32 of the developing cartridge 15 has a substantially rectangular boxlike shape. The housing 32 is formed with an opening 33 in its front end and has side walls 34, 35. A shaft support 36 is formed on both of the side walls 34, 35 at either end of the opening 33. The shaft supports 36 support the roller shaft 17*a* of the developing roller 17. Also, an accommodating groove 37 is formed in the side wall 35. The accommodating groove 37 has a long, thin shape that extends horizontally in the directions in which the developing cartridge 15 is mounted into and removed from the laser printer.

Figure 3:
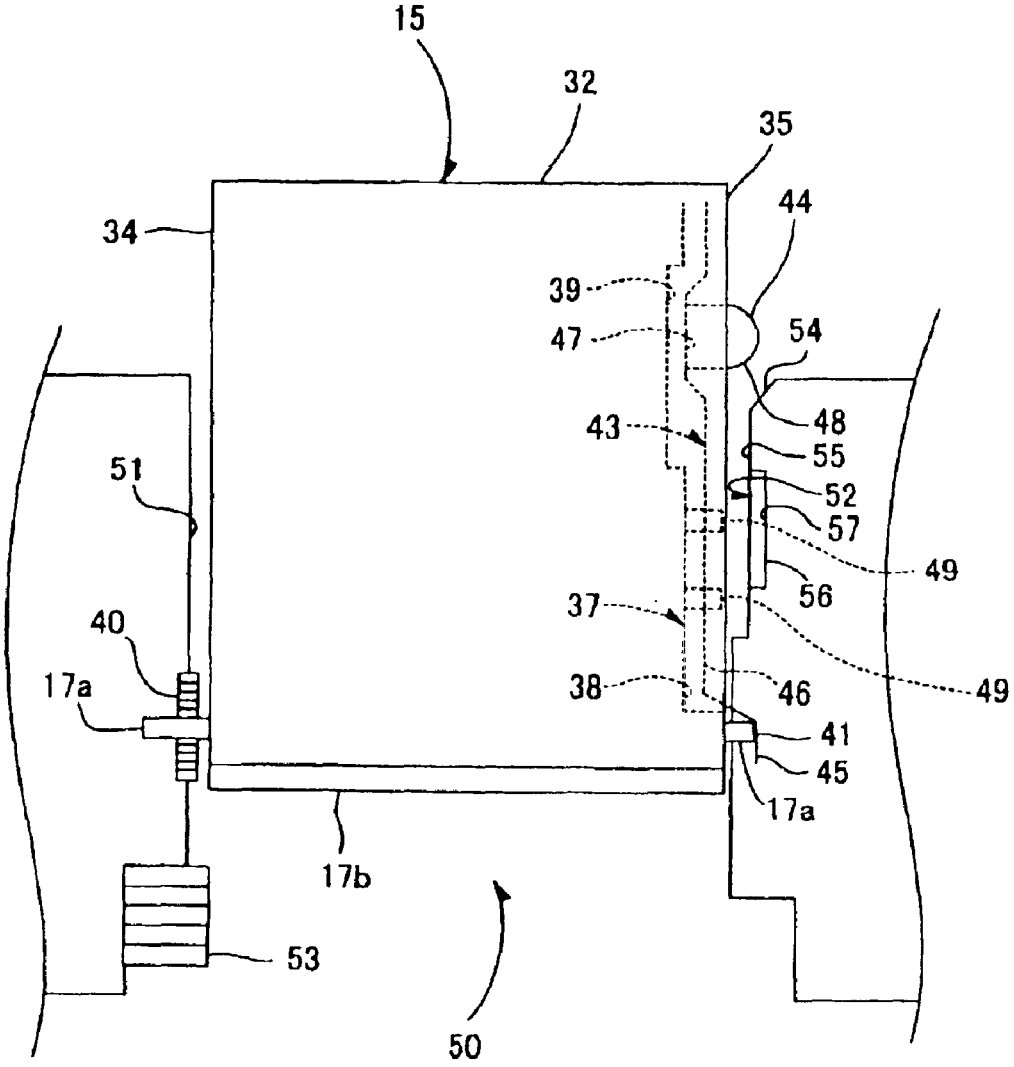
FIG. 3 is a partial plan view showing the developing cartridge of FIG. 2 being mounted in a mounting area of the laser printer.

As shown in FIG. 3, the accommodating groove 37 is indented inward into the housing 32 in the widthwise direction of the developing cartridge 15. Here, the widthwise direction of the developing cartridge 15 refers to a direction that extends perpendicular to the directions in which the developing cartridge 15 is mounted into and removed from the laser printer. The widthwise direction will be referred to alternatively as the inward widthwise direction to indicate the direction that extends from the side wall 35 toward the side wall 34 and the outward widthwise direction to indicate a direction that extends from the side wall 35 away from the side wall 34. In the view shown in FIG. 3, the accommodating groove 37 is formed on the right side of the housing 32 and extends left in the widthwise direction toward the interior of the housing 32.

The accommodating groove 37 includes a continuous first groove section 38 and a second groove section 39. The first groove section 38 forms the front section of the accommodating groove 37 and accommodates a connection portion 46 of a conductive member 43 to be described later. The second groove section 39 forms the rear section of the accommodating groove 37. The second groove section 39 is formed deeper into the interior of the housing 32 (in the widthwise direction) than the first groove section 38 and accommodates a contact member 44 of the conductive member 43.

The developing roller 17 is rotatably supported in the opening 33 of the housing 32. The roller shaft 17*a* protrudes farther in the axial directions of the developing roller 17 than does the roller section 17*b*. In other words, the roller shaft 17*a* protrudes from both axial ends of the roller section 17*b*. The protruding ends of the roller shaft 17*a* pass through the shaft supports 36 so that the developing roller 17 is rotatably supported in the opening 33 with the developing roller 17 partially exposed to outside of the housing 32. A drive gear 40 is provided to the left-side protruding end of the roller shaft 17*a*. The drive gear 40 meshingly engages with an input gear 53 to be described later and serves as a drive force input portion. The tip end 41 of the right-side protruding end of the roller shaft 17*a* is exposed so as to be able to contact a roller-axis contact 45 of the conductive member 43.

The conductive member 43 is for applying the developing bias from the high-voltage source to the developing roller 17 and is provided on the developing roller 17. The conductive member 43 includes the contact member 44, the roller-axis contact 45, and the connection portion 46. The contact member 44 is for connecting with a bias supply electrode 56, which serves as a bias supply member, provided at a corresponding position within the casing 2. The roller-axis contact 45 is for connecting with the tip end 41 of the roller shaft 17*a*. The connection portion 46 electrically connects the contact member 44 and the roller-axis contact 45 together.

The connection portion 46 and the roller-axis contact 45 are formed from an integral sheet of metal, such as a metal leaf spring. The connection portion 46 is formed in an elongated rectangular shape that fits within the first groove section 38 of the accommodating groove 37. The roller-axis contact 45 includes two bends. That is, the roller-axis contact 45 bends away at an angle from the front end of the connection portion 46, thereby forming a substantial V-shape with the connection portion 46. The roller-axis contact 45 again bends so that it again extends parallel with the connection portion 46 near the front end of the roller-axis contact 45. It should be noted that an indentation 47 is formed in the rear portion of the connection portion 46. The indentation 47 bends inward in the widthwise direction (leftward in FIG. 3) of the housing 32.

The contact member 44 is located in the indentation 47, but is a separate member from the connection portion 46. The contact member 44 has a substantial U-shape as viewed in plan. The contact member 44 is made from metal or a conductive resin material. Because the contact member 44 is a separate member from the connection portion 46, the contact member 44 can be made from a material and shape that ensures proper electrical connection with the bias supply electrode 56 of the bias supply unit.

The free end of the contact member 44 is formed with curved slanting surface 48 for guiding the developing cartridge 15 smoothly into the casing 2 while the developing cartridge 15 is being mounted into the laser printer. The curved slanting surface 48 is slanted with respect to the casing 2.

Two pins 49 are provided for fixing the lengthwise-central section of the connection portion 46 with the first groove section 38. The two pins 49 attach the conductive member 43 to the side wall 35 of the housing 32 so that the conductive member 43 is disposed within the accommodating groove 37 with the contact member 44 received in the second groove section 39 and the roller-axis contact 45 in contact with the tip end 41 of the roller shaft 17*a*.

When the conductive member 43 is mounted this way, the contact member 44 is disposed downstream from the roller-axis contact 45 with respect to the direction in which the developing cartridge 15 is moved when mounted into the laser printer. (Hereinafter, the direction in which the developing cartridge 15 is moved when mounted into the laser printer will be alternately referred to as merely the mounting direction of the image forming unit 5.) Said differently, the contact member 44 is disposed toward the rear side of the developing cartridge 15. Also, the contact member 44 can move within the second groove section 39, that is, left and right in the widthwise directions of the housing 32, by bending deformation allowed by the resiliency of the connection portion 46.

Because the contact member 44 is disposed downstream from the roller-axis contact 45 in the mounting direction of the developing cartridge 15, this means that the contact member 44 and the roller-axis contact 45 are located at different positions with respect to the mounting direction of the developing cartridge 15. Therefore, the position of the contact member 44 can be set to correspond to the position of the bias supply electrode 56, without taking the position of the roller-axis contact 45 into consideration. As a result, the bias supply electrode 56 may be disposed at the most suitable position in a cartridge mounting area 50 (to be described later) of the laser printer. Freedom of design is improved.

The roller-axis contact 45 is positioned constantly in contact with the tip end 41 of the roller shaft 17*a* by attachment of the conductive member 43 to the housing 32 of the developing cartridge 15. Therefore, the amount of wear on the roller-axis contact 45 can be reduced compared to a conventional configuration wherein the printer-side electrode slides into and out of contact with the roller shaft. Proper contact between the roller shaft 17*a* and the roller-axis contact 45 can be maintained for long periods of time.

Figure 4:
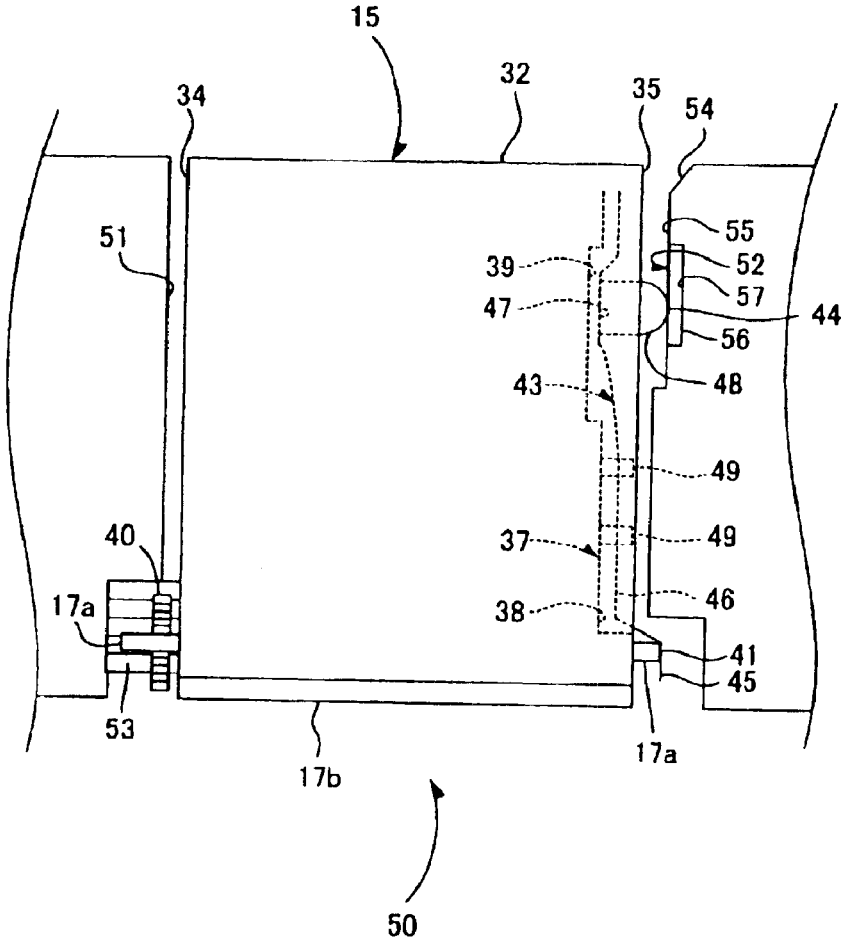
FIG. 4 is a partial plan view showing the developing cartridge fully mounted in the mounting area.

Next, configuration for mounting the developing cartridge 15 into the casing 2 and removing the developing cartridge 15 from the casing 2 will be described with reference to FIGS. 3 and 4. As shown in FIG. 3, the casing 2 is provided with a left-side wall 51 and a right-side wall 52 that define the cartridge mounting area 50 for receiving the developing cartridge 15 and that function to guide mounting and removal of the developing cartridge 15 into the casing 2. The left-side wall 51 and the right-side wall 52 are disposed facing each other separated in the widthwise direction of the developing cartridge 15 by a distance that corresponds to the width of the developing cartridge 15. Although not shown in the drawings, the casing 2 is also provided with an upper wall and a lower wall that are disposed facing each other separated in the thickness direction of the developing cartridge 15 by a distance that corresponds to the thickness of the developing cartridge 15.

The left-side wall 51 of the cartridge mounting area 50 forms a substantially flat surface. The input gear 53 for transmitting drive force for rotating the developing roller 17 is provided at the front side of the left-side wall 51.

Figure 5:
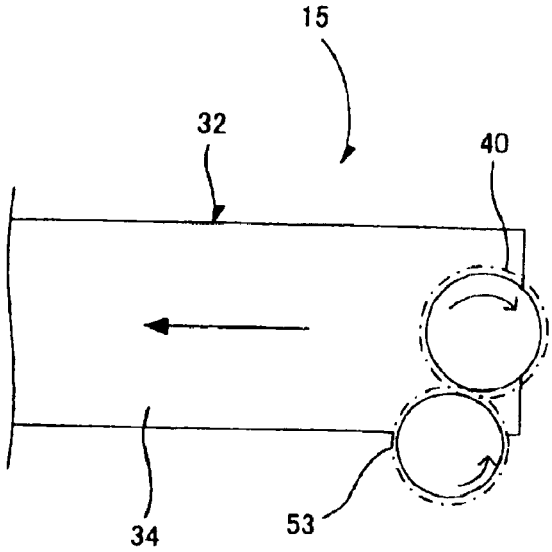
FIG. 5 is a side view showing gears for transmitting drive force from a drive source in the housing of the laser printer to the developing cartridge.
Figure 6:
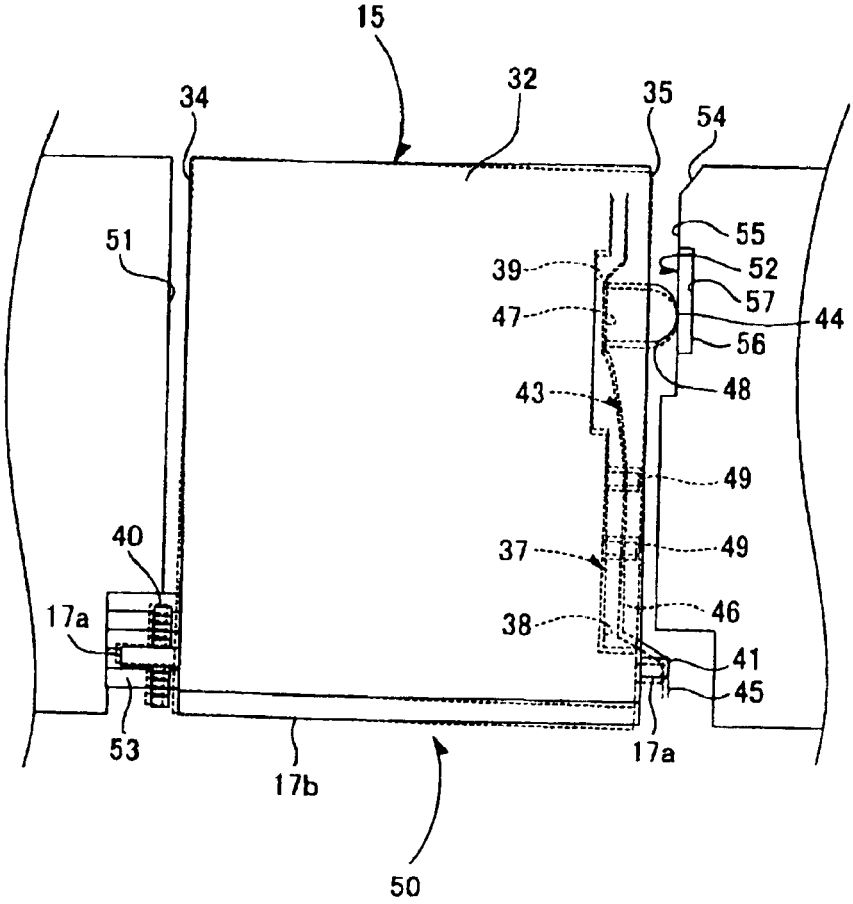
FIG. 6 is a partial plan view showing the developing cartridge being urged into a skewed orientation in the mounting area under drive force transmitted by the gears of FIG. 5.

Although not shown in the drawings, a motor and configuration for transmitting the drive force from the motor to the input gear 53 are provided within the casing 2. The input gear 53 is located in the casing 2 at a position that enables the input gear 53 to, as shown in FIG. 5, meshingly engage with the drive gear 40 of the roller shaft 17*a* while the developing cartridge 15 is mounted within the casing 2.

The right-side wall 52 includes a slanted surface 54 and a slide surface 55. The slanted surface 54 is located near the end of the right-side wall 52 and slants away from the left-side wall 51 (from the developing cartridge 15) in association with distance from the front of the right-side wall 52 to the end of the right-side wall 52. The slide surface 55 forms a substantially flat surface from the front end of the slanted surface 54 forward.

The slide surface 55 is formed with a rectangular shape groove 57 for receiving the bias supply electrode 56 in a manner to be described later. The groove 57 is located at a position along the slide surface 55 and is indented away from the developing cartridge 15 in the outward widthwise direction.

The bias supply electrode 56 is formed in a substantial rectangular plate shape and is embedded in the groove 57 so that the bias supply electrode 56 forms a substantially flat surface with the slide surface 55. That is, the bias supply electrode 56 is substantially flush with the slide surface 55 with respect to the widthwise direction of the developing cartridge 15. Said differently, the slide surface 55 is disposed at substantially the same position as the bias supply electrode 56 with respect to the widthwise direction.

The bias supply electrode 56 is connected to the high-voltage source (not shown), which is for applying a developing bias to each of the developing rollers 17 during development operations as mentioned above.

The developing cartridge 15 is mounted into the casing 2 by merely aligning the housing 32 of the developing cartridge 15 with the cartridge mounting area 50 and inserting the developing cartridge 15 horizontally forward into the cartridge mounting area 50. FIGS. 2 and 3 show the developing cartridge 15 before the developing cartridge 15 is mounted in the casing 2. In this condition, the contact member 44 is at a non-mounted position wherein the contact member 44 is urged to protrude outward from the right side wall 35 of the housing 32 in the outward widthwise direction under resilient urging force of the connection portion 46. As the developing cartridge 15 is being mounted into the cartridge mounting area 50, first the curved slanting surface 48 of the contact member 44 abuts against the slanted surface 54 of the casing 2. As the developing cartridge 15 is mounted progressively farther into the cartridge mounting area 50, the contact member 44 slides against the slanted surface 54 and so gradually moves in the inward widthwise direction into the housing 32 against the resilient force of the connection portion 46.

Once the contact member 44 has slid to the slide surface 55, the contact member 44 is located in a mounted position. The mounted position is the position of the contact member 44 in the widthwise direction when the contact member 44 is in contact with the bias supply electrode 56. Because the outer surfaces of the slide surface 55 and the bias supply electrode 56 are flush with each other, the contact member 44 will be in the mounted position by the time it reaches the slide surface 55. The contact member 44 remains in the mounted position as the contact member 44 further slides to the bias supply electrode 56 as shown in FIG. 4. The drive gear 40 and the input gear 53 are in meshing engagement with each other while the contact member 44 is in its mounted position.

Developing operations can be performed after the developing cartridge 15 is completely mounted into the cartridge mounting area 50. During developing operations, drive force from the motor (not shown) is transmitted to the input gear 53 so that the input gear 53 is driven to rotate counterclockwise as indicated by an arrow in FIG. 5. The drive gear 40, which is in meshing engagement with the input gear 53, is driven to rotate clockwise as indicated by an arrow in FIG. 5. Drive force of the drive gear 40 applies a forward-directed force to the left-hand side wall 34 as indicated by an arrow in FIG. 5. As indicated by broken line in FIG. 6, this forward-directed force operates to move the developing cartridge 15 slightly askew in the cartridge mounting area 50 during developing operations. More specifically, the rear side of the right-hand side wall 35 of the developing cartridge 15 moves toward the right-side wall 52 of the cartridge mounting area 50 so that the contact member 44 presses more firmly against the bias supply electrode 56.

During developing operations, a bias from the high-voltage source (not shown) in the casing 2 is applied to the roller shaft 17*a* of the rotating roller developing roller 17 through the bias supply electrode 56, the contact member 44, the connection portion 46, and the roller-axis contact 45.

The opposite procedures from those for mounting the developing cartridge 15 into the casing 2 are performed to remove the developing cartridge 15 from the casing 2. That is, the housing 32 of the developing cartridge 15 is merely pulled horizontally rearward from the cartridge mounting area 50. As a result, as shown in FIGS. 2 and 3, the contact member 44 is located at its non-mounted position where the contact member 44 protrudes freely outward from the right side wall 35 of the housing 32 in the outward widthwise direction under resilient force of the connection portion 46.

When the developing cartridge 15 is being mounted into the casing 2, the curved slanting surface 48 of the contact member 44 abuts against the slanted surface 54 of the right-side wall 52 so that the contact member 44 is guided gradually in the inward widthwise direction into the housing 32. This configuration prevents damage to the contact member 44 and allows the developing cartridge 15 to be smoothly mounted into the casing 2.

The contact member 44 slides against the slide surface 55 and is guided by the slide surface 55 to the bias supply electrode 56. In this way, the slide surface 55 insures that both mounting and removing operations of the developing cartridge 15 are carried out smoothly. Because the slide surface 55 and the bias supply electrode 56 of the cartridge mounting area 50 form a single flat surface, the contact member 44 properly contacts the bias supply electrode 56 after sliding along the slide surface 55, even if the contact member 44 does not move in the widthwise direction. Therefore, proper contact between the contact member 44 and the bias supply electrode 56 can be achieved.

While the contact member 44 and the bias supply electrode 56 are in contact with each other, the contact member 44 is pressed into the housing 32 in the inward widthwise direction against the resilient force of the connection portion 46. Therefore, the contact member 44 is pressed against the bias supply electrode 56 by the reactive force of the resilient force of the connection portion 46. For this reason, the contact member 44 and the roller-axis contact 45 are properly maintained in contact.

That is, while the developing cartridge 15 is being mounted into the casing 2, the contact member 44 moves in the inward widthwise direction into the housing 32 against the resilient force of the connection portion 46. The reactive force of the resilient force of the connection portion 46 reliably brings the contact member 44 into contact with the bias supply electrode 56. While the developing cartridge 15 is being removed from the casing 2, the resilient force of the connection portion 46 moves the contact member 44 in the outward widthwise direction of the housing 32 into the non-mounted position.

There is a possibility that the conductive member 43 may permanently deform under contact with the right-side wall 52 during mounting and removal of the developing cartridge 15 into and out from the casing 2. This can result in poor contact between the contact member 44 and the bias supply electrode 56.

However, even if the conductive member 43 permanently deforms, the conductive member 43 will be replaced when the developing cartridge 15 is replaced so that proper contact can always be achieved between the contact member 44 and the bias supply electrode 56. Accordingly, even if contact between the contact member 44 and the bias supply electrode 56 becomes defective, there is no need to send the entire laser printer 1 to the manufacturer for repair: the user can simply correct the problem in a short time.

It is desirable that the distance between the nonmounted position and the mounted position of the contact member 44 be within the range of 1 mm to 5 mm. By setting the movement amount of the contact member 44 within this range, the 42 will press against the bias supply electrode 56 with a suitable pressing force.

When developing roller 17 is driven to rotate during developing operations, the rear part of the right-hand side surface 35 of the developing cartridge 15 receives a force in the direction of the right-side wall 52 as described above. Therefore, the contact member 44, which is located at the rear part of the right-hand side surface 35, is pressed toward the bias supply electrode 56, which is provided on the right-side wall 52. For this reason, the contact member 44 and the bias supply electrode 56 can be reliably brought into contact with each other.

Next, modifications of the embodiment will be described.

Figure 7:
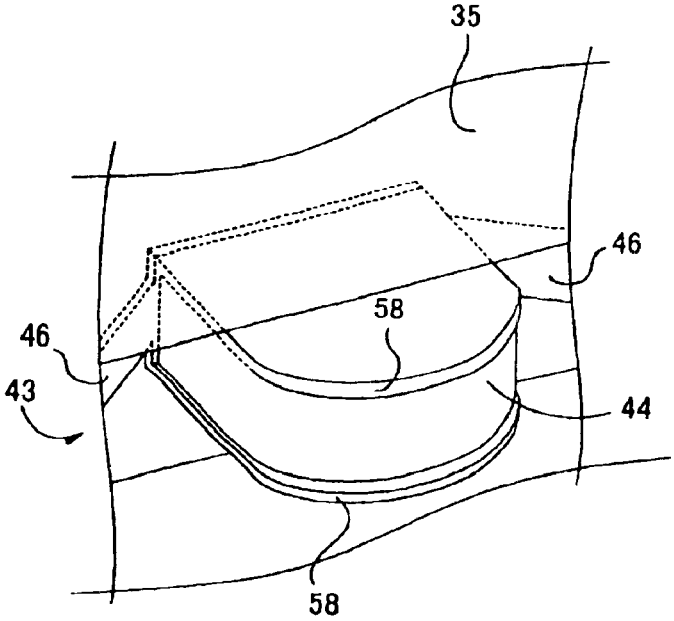
FIG. 7 is a perspective view partially in phantom showing a modification of the embodiment wherein guard members are provided for guarding a first contact point of the developing cartridge while the developing cartridge is being mounted into the mounting area.
Figure 8:
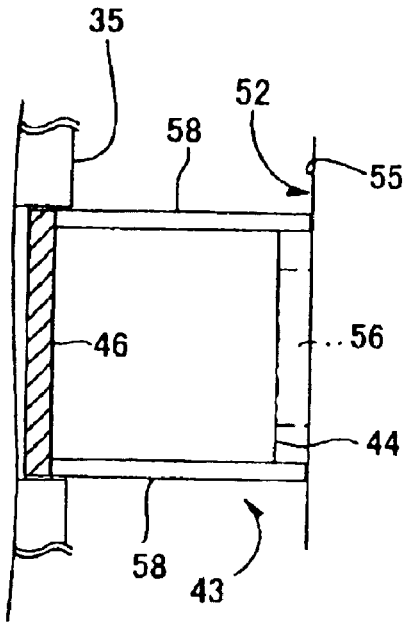
FIG. 8 is a side view showing the guard members and the first contact member of FIG. 7.

As shown in FIGS. 7 and 8, guard members 58 may be provided to the developing cartridge 15. The guard members 58 are protrusions for guiding the contact member 44 to the bias supply electrode 56 without the contact member 44 contacting the slide surface 55 of the right-side wall 52.

The guard members 58 are formed as separate members from the contact member 44 and are disposed in the indentation 47 in a condition of covering the upper and lower surfaces of the contact member 44. Explained in more detail, the guard members 58 sandwich the contact member 44 therebetween from upper and lower sides and protrude out farther in the outward widthwise direction of the housing 32 than does the contact member 44.

When the guard members 58 are provided as in this modification, then as indicated in broken line in FIG. 8 the bias supply electrode 56 should be provided so as to protrude slightly in the inward widthwise direction from the slide surface 55.

By providing the guard members 58 in this manner, then as shown in FIG. 8 the two guard members 58 slide against the slide surface 55 of the right-side wall 52 while the developing cartridge 15 is being mounted into the casing 2. Therefore, the contact member 44 will not contact the slide surface 55 during mounting and removal of the developing cartridge 15. Moreover, the contact member 44 will properly contact the bias supply electrode 56 when the contact member 44 is moved into the mounted position at the bias supply electrode 56. With this configuration, the contact member 44 will not be soiled or stained by contact with the slide surface 55 while the developing cartridge 15 is being mounted into or removed from the casing 2. Connection between the contact member 44 and the bias supply electrode 56 will be that much better.

Figure 9:
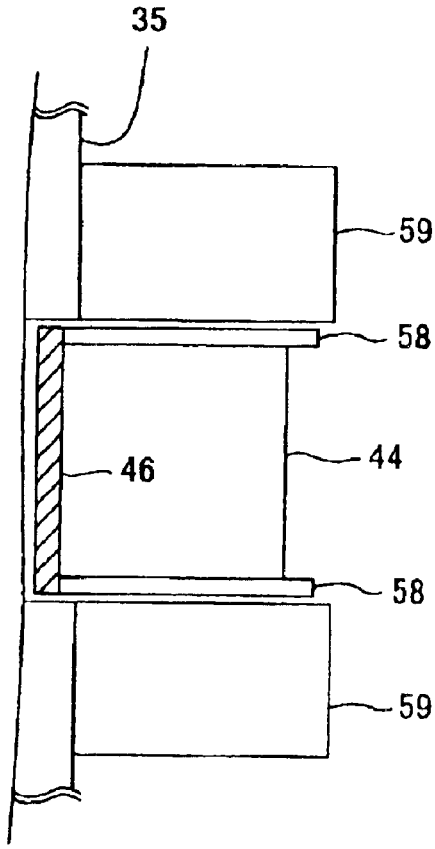
FIG. 9 is a side view showing a further modification of the modification of FIG. 8 wherein protecting members for protecting the first contact point are further provided.

As shown in FIG. 9, the developing cartridge 15 may be provided with protecting members 59 for protecting the contact member 44.

As shown in FIG. 9, the protecting members 59 sandwich the guard members 58 from above and below. The protecting members 59 each are formed thicker than either of the guard members 58. The protecting members 59 protrude from the side wall 35 of the housing 32 and extend farther in the outward widthwise direction than do the guard members 58. More specifically, the protecting members 59 protrude farther in the outward widthwise direction than the peripheral edge of the guard members 58 while the contact member 44 has moved into the non-mounted position. Therefore, the protecting members 59 will properly protect the contact member 44, for example, when the developing cartridge 15 is placed on a desk or other surface with the contact member 44 in confrontation with the surface. Damage to the contact member 44 can be prevented. The contact member 44 and the bias supply electrode 56 will more reliably connect with each other when the developing cartridge 15 is mounted into the laser printer.

Figure 10:
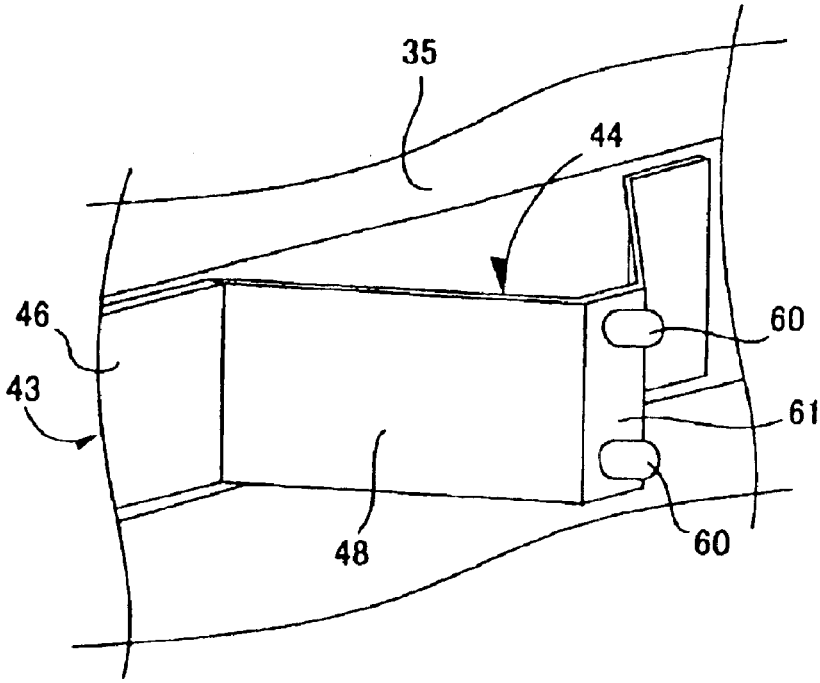
FIG. 10 is a partial perspective view showing a modification of the first contact point of the embodiment wherein guard members are provided for protecting the first contact point while the developing cartridge is being mounted into the mounting area.
Figure 11:
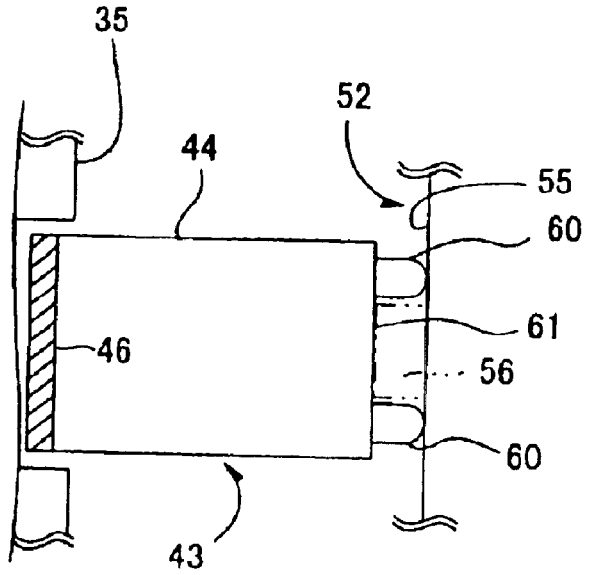
FIG. 11 is a side view showing the modification of FIG. 10.

Although the embodiment described the contact member 44 as being a separate member from the connection portion 46 and the roller-axis contact 45, the contact member 44 can be provided integrally from the same leaf spring member as the connection portion 46 and the roller-axis contact 45 as shown in FIGS. 10 and 11. In the example of FIGS. 10 and 11, the contact member 44 is formed by bending the leaf spring member into a substantially trapezoidal shape (as viewed in plan). More specifically, the end of the connection portion 46 is bent toward the outward widthwise direction of the housing 32 to form a slanted surface that serves as curved slanting surface 48. The leaf spring member is again bent in a direction parallel to the connection portion 46 to form a protruding surface 61 for electrically connecting with the bias supply electrode 56. In this modification, guard members 60 are provided on the protruding surface 61. In the same manner as the guard members 58, the guard members 60 are protrusions for guiding the contact member 44 to the bias supply electrode 56 without the contact member 44 contacting the slide surface 55 of the right-side wall 52.

The guard members 60 are two pins formed on the protruding surface 61 and are separated form each other vertically by a predetermined distance.

When the guard members 60 are provided in this manner, then as indicated by a two-dot chain line in FIG. 11, the bias supply electrode 56 is provided so as to protrude slightly from the slide surface 55 in the inward widthwise direction in confrontation with the contact member 44. The bias supply electrode 56 is formed with a thickness (in the vertical direction) that is thin enough to fit between the two guard members 60.

The two guard members 60 slide against the slide surface 55 of the right-side wall 52 as shown in FIG. 11 while the developing cartridge 15 is being mounted into the laser printer. Therefore, the contact member 44 will not contact the slide surface 55. The contact member 44 will properly contact the bias supply electrode 56 when the contact member 44 has moved into the mounted position while in confrontation with the bias supply electrode 56. With this configuration, the contact member 44 will not be soiled or stained by contact with the slide surface 55 while the developing cartridge 15 is being mounted into or removed from the casing 2. Connection between the contact member 44 and the bias supply electrode 56 will be that much better.

Figure 12:
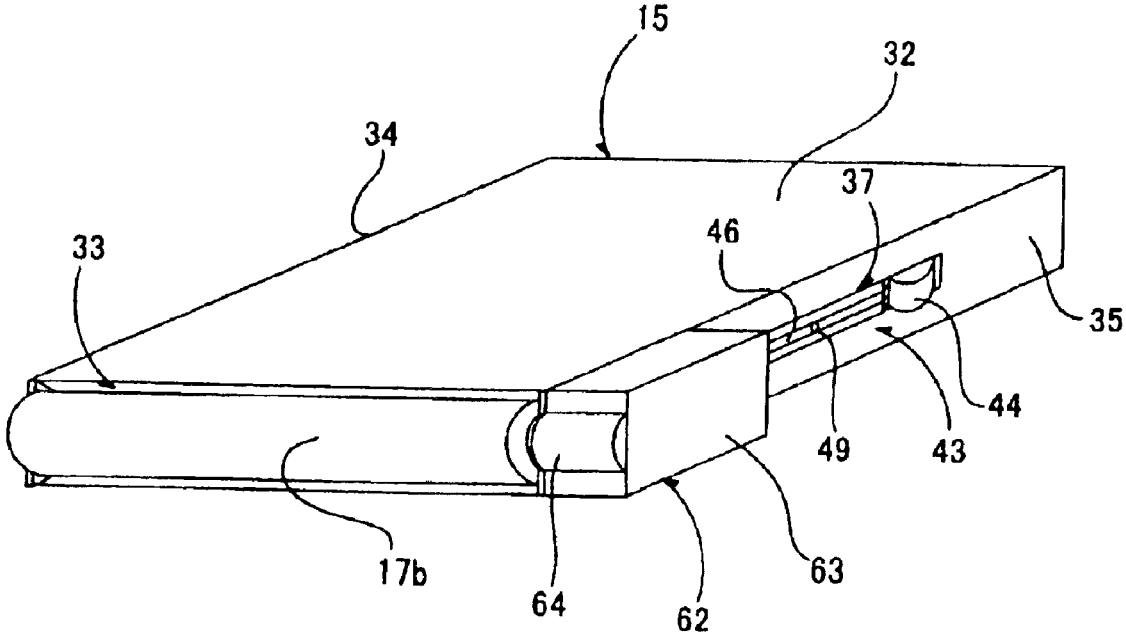
FIG. 12 is a perspective view showing a modification of the embodiment wherein a cover is provided for protecting the first contact point.

A cover 62 for protecting the contact member 44 may be provided as shown in FIG. 12. The cover 62 is provided at the front side of the right-hand side wall 35. The cover 62 includes a cover portion 63 and an axial cover portion 64 formed integrally together. The cover portion 63 is a rectangular box shape with an opening at the side that faces the right-hand side wall 35. The axial cover portion 64 is formed at the front surface of the cover portion 63 in a substantially half-cylinder shape.

The cover portion 63 is attached to the front side of the right-hand side wall 35 so as to cover the front end of the connection portion 46, which is in contact with the roller-axis contact 45. The axial cover portion 64 covers the point of contact between the roller-axis contact 45 and the tip end 41 of the roller shaft 17*a*.

The surface of the roller-axis contact 45 and the tip end 41 of the roller shaft 17*a* that contact each other are normally coated with a lubricant to insure smooth rotation of the roller shaft 17*a*. Because the cover 62 covers the point of contact between the roller-axis contact 45 and the tip end 41, there is no fear that the lubricant will get on the user's hands as he/she mounts or removes the developing cartridge 15. This insures that the user can smoothly mount or dismount the developing cartridge 15.

Figure 13:
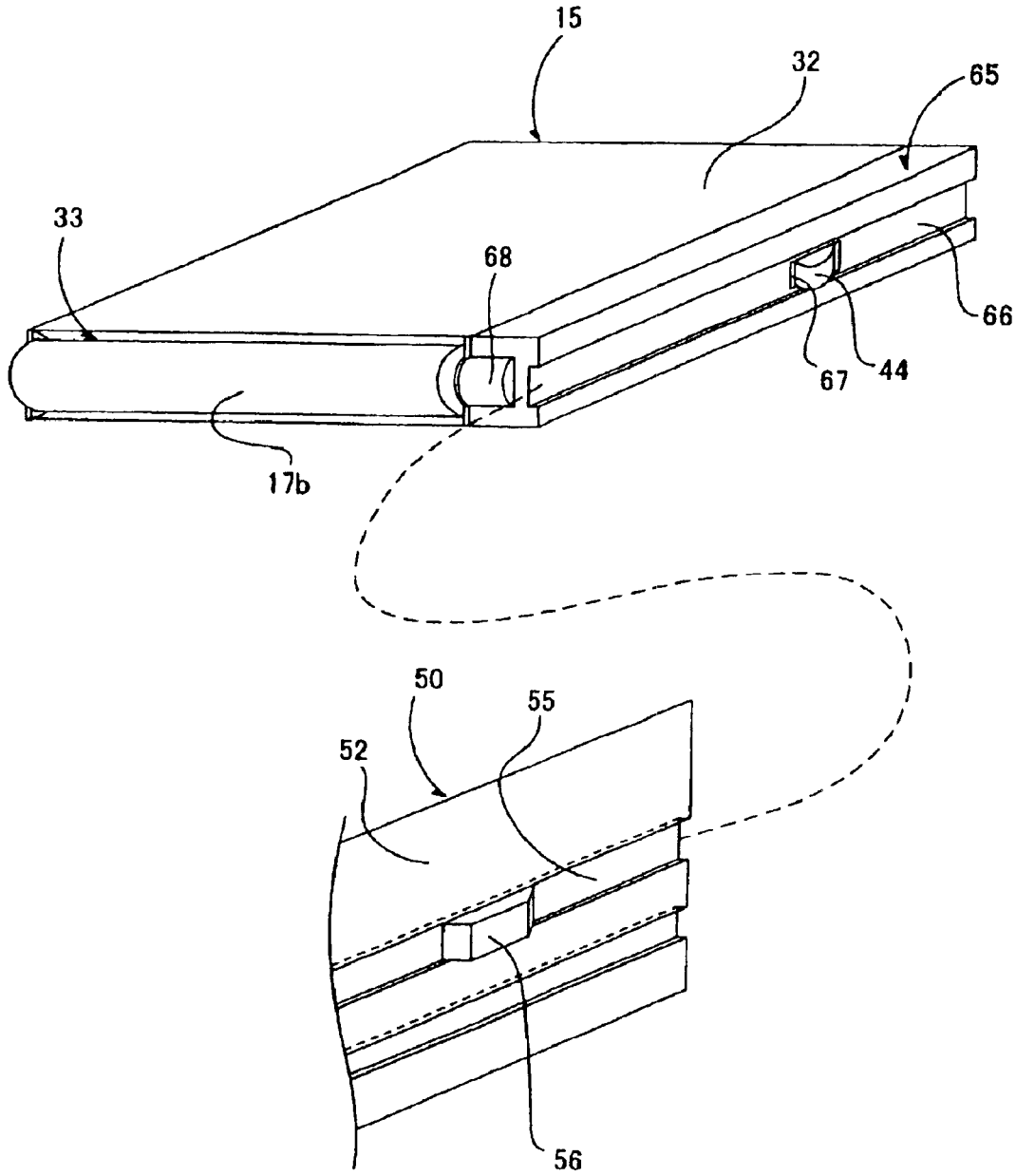
FIG. 13 is a perspective view showing a modification of the embodiment wherein a guide member is provided.

As shown in FIG. 13, a guide member 65 for guiding mounting and removal movement of the developing cartridge 15 can be provided to the right-hand side wall 35 of the housing 32. The guide member 65 is formed in an elongated and substantially rectangular box-like shape to substantially the same length as the front-to-rear length of the right-hand side wall 35. The guide member 65 is open at the side that faces the right-hand side wall 35 and is attached to the right-hand side wall 35 of the housing 32 so as to cover the entire right-hand side wall 35 from front to rear end, including the conductive member 43.

The guide member 65 includes a guide surface 66 and an axial cover portion 68. The guide surface 66 extends across the entire side surface that faces in the outward widthwise direction. The guide surface 66 is formed with a groove that is indented in the inward widthwise direction and with an opening 67 at a position aligned with the contact member 44. While the contact member 44 is in the non-mounted position, the contact member 44 protrudes from the guide surface 66 through the opening 67 in the outward widthwise direction. The axial cover portion 68 is formed on the front end surface of the guide member 65 and covers the point of contact between the roller-axis contact 45 and the tip end 41 of the roller shaft 17*a*.

With this configuration, the roller shaft 17*a* and the conductive member 43 are disposed inside the guide member 65 and the tip end of the roller-axis contact 45 protrudes through the opening 67. That is, although the roller-axis contact 45 and the connection portion 46 are disposed at a position in the inward widthwise direction from the guide surface 66 while the developing cartridge 15 is not mounted in the laser printer, at the same time the tip end of the contact member 44 is located at a position in the outward widthwise direction from the guide surface 66.

When the guide member 65 is provided in this way, the slide surface 55 at the right-side wall 52 of the cartridge mounting area 50 is formed with a protruding shape as shown in FIG. 13 so as to be engagable in the groove-shaped guide surface 66. Also, the bias supply electrode 56 protrudes in the outward widthwise direction from so as to form an indentation (not shown) in the slide surface 55.

The protruding slide surface 55 is engaged in the groove-shaped guide surface 66 when the developing cartridge 15 is to be mounted into the laser printer. The developing cartridge 15 can be properly guided during mounting into, and also removal from, the laser printer by the guide surface 66 and the slide surface 55 sliding against each other.

It should be noted that while the developing cartridge 15 is mounted in the laser printer 1 and the contact member 44 is in the mounted position, the tip end of the contact member 44 protrudes from the guide surface 66 in the outward widthwise direction of the housing 32. Therefore, the contact member 44 will reliably connect with the bias supply electrode 56, which forms an indentation on the slide surface 55 as described above.

By providing the guide member 65 in this way, the roller-axis contact 45, and the connection portion 46 are located in the inward widthwise direction from the guide surface 66 and the contact member 44 is located in the outward widthwise direction from the guide surface 66 while the developing cartridge 15 is not mounted in the laser printer, the roller shaft 17*a*. Therefore, the laser printer can be made more compact and thinner.

The contact member 44 is provided so that its tip end protrudes from the opening 67 of the guide surface 66. The groove shape of the guide surface 66 prevents the user from unintentionally contacting the contact member 44 and deforming the contact member 44 and also the conductive member 43.

Figure 14:
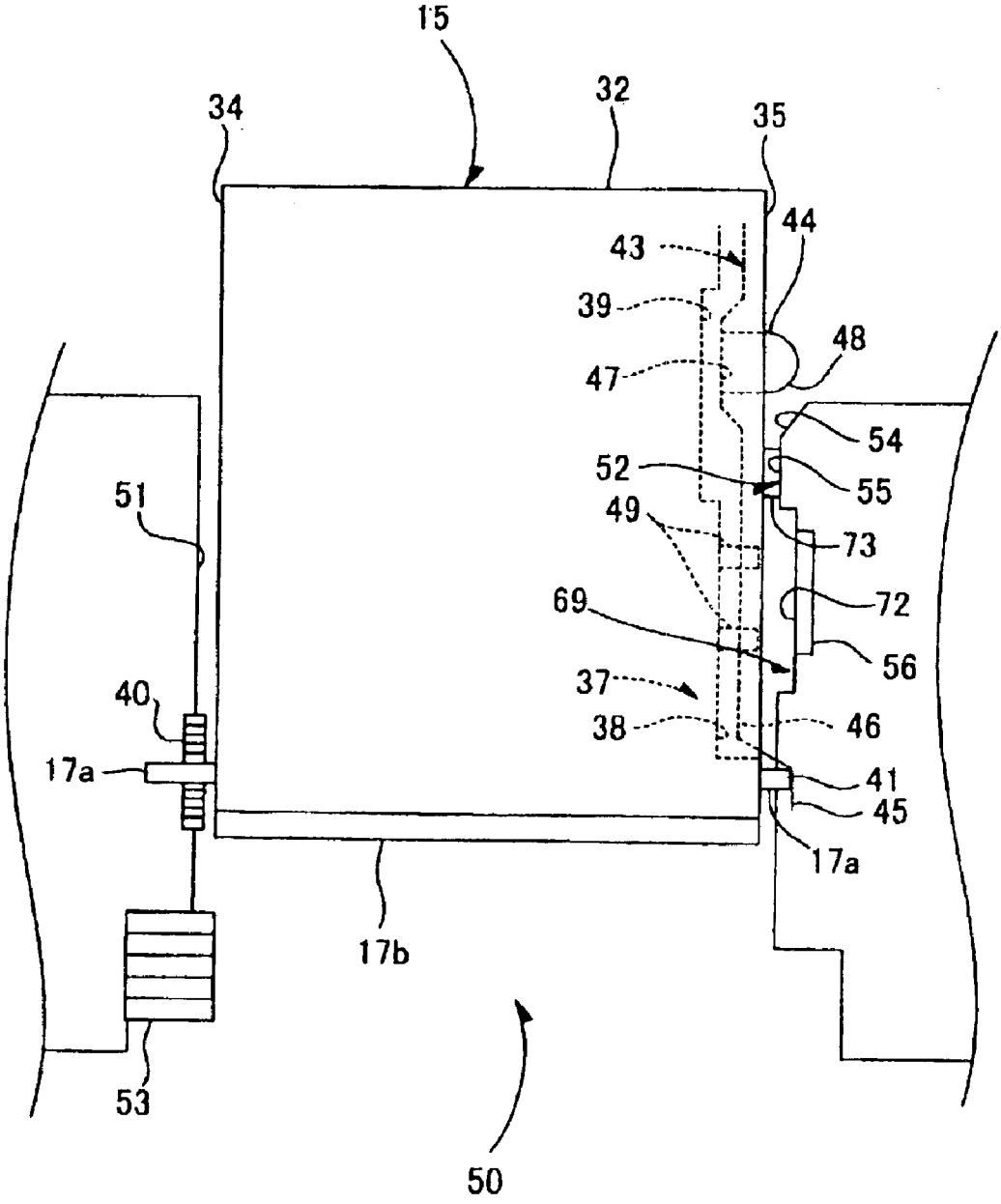
FIG. 14 is a plan view showing a modification wherein a receiving portion is formed in the mounting area.

As shown in FIG. 14, a groove-shape receiving portion 69 may be formed in the right-side wall 52 of the cartridge mounting area 50 at a position to the front of the slide surface 55. The receiving portion 69 indents in the outward widthwise direction. The receiving portion 69 includes a receiving surface 72 in which the bias supply electrode 56 is embedded. With this configuration, the slide surface 55 is disposed farther in the inward widthwise direction than the bias supply electrode 56.

Figure 15:
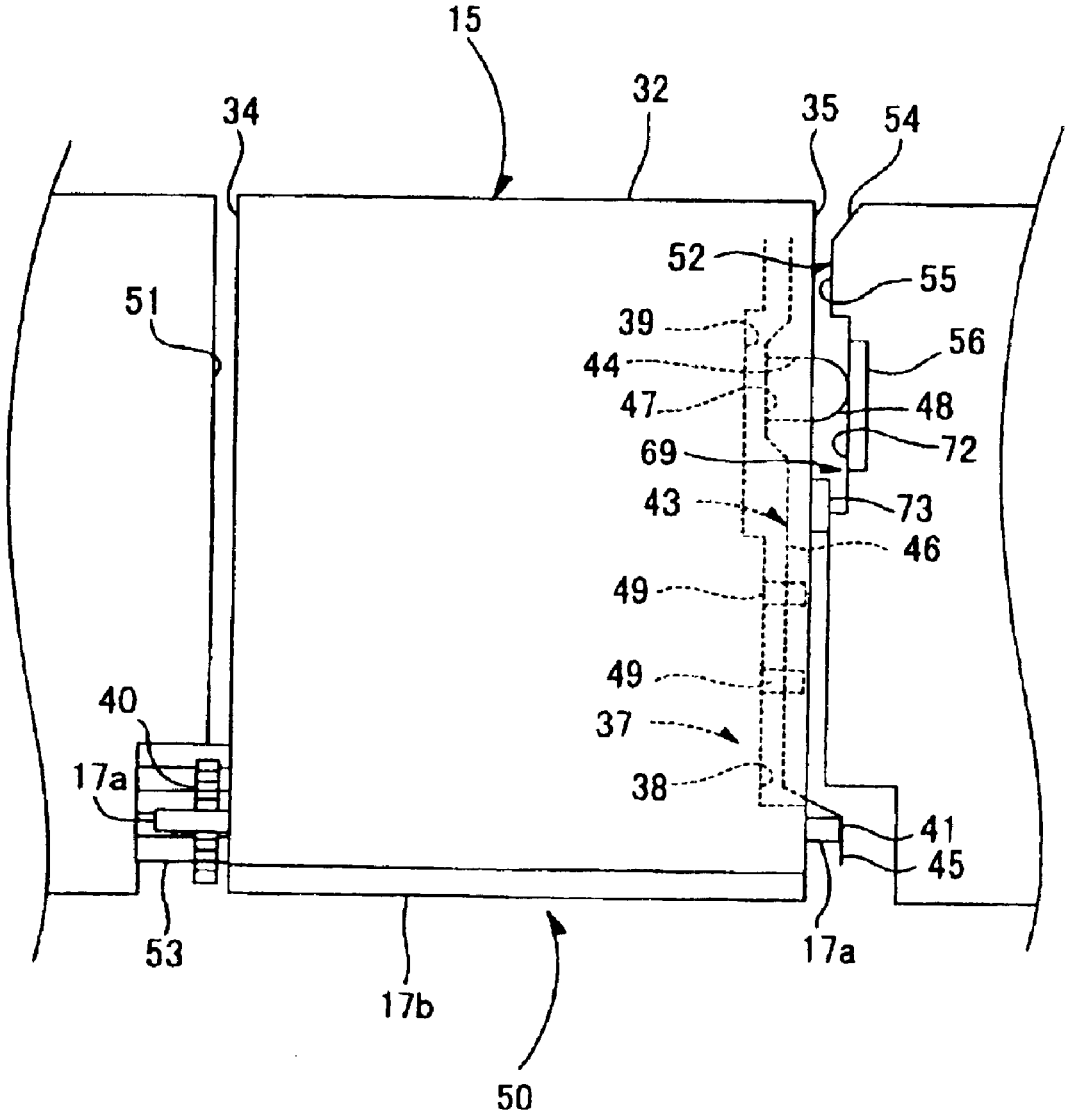
FIG. 15 is a plan view showing the modification of FIG. 14, wherein the developing cartridge is fully mounted in the mounting area.

By providing the receiving surface 72 in this way, when the contact member 44 moves into confrontation with the receiving portion 69 after sliding in confrontation with the slide surface 55 while the developing cartridge 15 is being mounted into the laser printer, then as shown in FIG. 15 the resilient force of the connection portion 46 moves the contact member 44 in the outward widthwise direction of the housing 32 so that the contact member 44 contacts the bias supply electrode 56, which is embedded in the receiving surface 72. By this, the contact member 44 will stop more precisely at the bias supply electrode 56 while the developing cartridge 15 is being mounted into or removed from the laser printer. Further, because the bias supply electrode 56 is disposed to the inside of the slide surface 55, the user will be less likely to unintentionally contact the bias supply electrode 56.

As shown in FIG. 14, a cleaning member 73 for cleaning the slide surface 55 may be provided on the right-hand side wall 35 of the housing 32. The cleaning member 73 is made from a sheet of felt or similar material and protrudes in the outward widthwise direction of the housing 32 from the accommodating groove 37. The cleaning member 73 overlaps the contact member 44 with respect to horizontal, that is, the front/rear directions in which the developing cartridge 15 moves when mounted and removed.

By providing the cleaning member 73 in this way, the cleaning member 73 contacts and cleans the portion of the slide surface 55 that the contact member 44 slides along while the developing cartridge 15 is being mounted into and removed from the laser printer. Therefore, the contact member 44 can be maintained clean. For this reason, proper electrical connection between the contact member 44 and the bias supply electrode 56 can be achieved.

The cleaning member 73 may instead be provided on the slide surface 55 of the right-side wall 52. In this case, the cleaning member 73 may be provided at a position of the slide surface 55 that confronts the contact member 44 while the developing cartridge 15 is being mounted into and removed from the laser printer. With this configuration, the cleaning member 73 contacts the contact member 44 while the developing cartridge 15 is being mounted into and removed from the laser printer so that the contact member 44 is cleaned directly. Therefore, the cleaning member 73 will clean off any dust or foreign matter clinging to the contact member 44 before the contact member 44 contacts the bias supply electrode 56, so that proper electrical connection between the contact member 44 and the bias supply electrode 56 can be achieved.

In the modification of FIGS. 16 and 17, the bias supply electrode 56 is disposed so that the contact member 44 contacts the bias supply electrode 56 while the developing cartridge 15 is in the contact position but not while the developing cartridge 15 is in the separated position. That is, as shown in FIG. 16, the receiving portion 69 of this modification includes a front wall 70 and a rear wall 71 that slant from the receiving surface 72 so that the receiving portion 69 broadens outward form the receiving surface 72. The bias supply electrode 56 is embedded in the front wall 70 of the receiving portion 69.

When the developing cartridge 15 is mounted into the laser printer and the developing cartridge 15 is in the separated position as shown in FIG. 16, at this time the tip 44*a* of the contact member 44 contacts the receiving surface 72 and the rear edge 44*b* of the contact member 44 contacts the rear wall 71. When development operations are to be performed, then the cams 74 are driven to move the developing cartridge 15 into the contact position as shown in FIG. 17. At this time, the tip 44*a* contacts the receiving surface 72 and the front edge 44*c* of the contact member 44 contacts the front wall 70.

The developing cartridge 15 is constantly urged rearward by a spring (not shown). Therefore, when the cams 74 are again driven to rotate to move the developing cartridge 15 from the contact position, the urging force of the spring moves the developing cartridge 15 into the separated position.

With this configuration, while development operations are being performed, the developing cartridge 15 is moved into the contact position so that the contact member 44 and the bias supply electrode 56 contact each other. On the other hand, while development operations are not being performed, the developing cartridge 15 is moved into the separated position so that the contact member 44 is separated from the bias supply electrode 56. For this reason, the developing bias will not be applied to the developing roller 17 while development operations are not being performed. Therefore, the developing roller 17 can be reliably operated and safety of the laser printer can be enhanced.

In the modification shown in FIGS. 16 and 17, tip 44*a* of the contact member 44 slides in confrontation with the slide surface 55 while the developing cartridge 15 is being mounted into or removed from the laser printer.

While the developing cartridge 15 is mounted in the laser printer, the tip 44*a* of the contact member 44 contacts the receiving surface 72 and the rear edge 44*b* of the contact member 44 contacts the rear wall 71 while development operations are not being performed and the tip 44*a* contacts the receiving surface 72 and the front edge 44*c* of the contact member 44 contacts the front wall 70 while development operations are being performed. That is, the front edge 44*c* does not contact the receiving surface 72 while the developing cartridge 15 slides from a non-developing position (separated position) into a developing position (contact position) and from the developing position (contact position) into the non-developing position (separated position), but only contacts the bias supply electrode 56 at the rear wall 71 when development operations are being performed. For this reason, the front edge 44*c* of the contact member 44 will not get dirty by sliding along a surface with movement of the developing cartridge 15. Proper electrical contact between the contact member 44 and the bias supply electrode 56 can during development can be reliably achieved.

While the invention has been described in detail with reference to the specific embodiments thereof, it would be apparent to those skilled in the art that various changes and modifications may be made therein without departing from the spirit of the invention.

For example, the embodiment described the invention applied to the developing cartridge 15. However, the invention may be applied to any removable member. For example, the present invention can be applied to a process cartridge which includes a developing cartridge and a photosensitive drum that are removed integrally together from the casing of, for example, a monochrome laser printer. Also, the present invention may be applied to the sheet-feed tray 6, which is removable from the casing 2.

What is claimed is:

1. A detachable member for use in an image forming device including an electrical connection section, the detachable member comprising:

a housing that is mountable in the image forming device by moving in a mounting direction and removable from the image forming device by moving in a removal direction, the housing substantially encompassing an interior; and a conductive member that is connected to the housing, the conductive member moving in a contact movement direction under contact by the electrical connection section while the housing is being mounted in the image forming device and electrically connecting with the electrical connection section of the image forming device while the housing is mounted in the image forming device, the contact movement direction being from outside the housing toward the interior of the housing and orthogonal to the mounting direction and the removal direction.

2. The detachable member as claimed in claim 1, further comprising an operation member that operates under application of a bias, wherein the conductive member includes:

a first contact point that electrically connects with a bias supply member of the electrical connection section of the image forming device while the housing is mounted in the image forming device;

a second contact point that is electrically connected with the operation member; and a connection member that connects the first contact point and the second contact point to each other, the first contact point being positioned downstream from the second contact point with respect to the mounting direction.

3. The detachable member as claimed in claim 2, wherein the operation member is rotatably supported on an axial shaft, the shaft having an end surface, the second contact point being electrically connected with the end surface of the shaft.

4. The detachable member as claimed in claim 2, wherein the first contact point is movable between a mounted position and a non-mounted position, the first contact point being in the mounted position while the housing is mounted in the image forming device and in the non-mounted position while the housing is not mounted in the image forming device, the mounted position being farther than the non-mounted position in the contact movement direction.

5. The detachable member as claimed in claim 4, wherein the connection member generates an urging force that urges the first contact member into the non-mounted position, contact between the first contact member and the electrical connection section overcoming the urging force of the connection member.

6. The detachable member as claimed in claim 2, wherein the first contact point is a separate member from the connection member.

7. The detachable member as claimed in claim 2, further comprising a protruding member that prevents the first contact point from contacting the image forming device during mounting of the housing in the mounting direction until the first contact point reaches the bias supply member of the image forming device.

8. The detachable member as claimed in claim 2, further comprising a protecting member that protects the first contact point.

9. The detachable member as claimed in claim 2, wherein the operation member includes a rotatable connecting portion for electrically connecting with the second contact point, and further comprising a cover for covering the second contact point.

10. The detachable member as claimed in claim 2, wherein the first contact point is provided on a surface of the housing, the operation member including a drive force input portion for inputting drive force from the image forming device, the drive force input portion located at a position of the housing so that the drive force input through the drive force input unit urges the surface of the housing that is provided with the conductive member toward the image forming device.

11. The detachable member as claimed in claim 10, wherein the drive force input unit and the first contact point are disposed at opposite sides of the housing with respect to the contact movement direction.

12. The detachable member as claimed in claim 2, wherein conductive member further includes a sliding contact member that contacts the electrical connection section of the image forming device while the housing is being mounted into the image forming device, the sliding contact member being a separate member from the first contact point.

13. The detachable member as claimed in claim 2, wherein the first contact point slides along a slide contact surface of the electrical connection section while the housing is being mounted into the image forming device, and further comprising cleaning member that cleans the slide contact surface of the electrical connection section.

14. The detachable member as claimed in claim 2, wherein the first contact point includes a slanting portion for guiding the housing during mounting of the housing in the mounting direction.

15. The detachable member as claimed in claim 1, further comprising a guide member that guides the housing while the housing is being mounted in the image forming device, the conductive member being provided substantially within the guide member.

16. The detachable member as claimed in claim 15, further comprising an operation member that operates under application of a bias, wherein the conductive member includes:

a first contact point that electrically connects with a bias supply member of the electrical connection section of the image forming device while the housing is mounted in the image forming device;

a second contact point that is electrically connected with the operation member; and a connection member that connects the first contact point and the second contact point to each other, the first contact point being positioned downstream from the second contact point with respect to the mounting direction, wherein:

the guide member includes a guide surface for sliding against the electrical connection section of the image forming device while the housing is being mounted in the image forming device; and the operation member, the second contact point, and the connection member are in the contact movement direction from the guide surface, and at least a portion of the first contact point is disposed in a direction opposite from the contact movement direction from the guide surface, while the housing is not mounted in the image forming device.

17. A developing unit comprising the detachable member claimed in claim 1.

18. A process unit comprising the detachable member claimed in claim 1.

19. An image forming device comprising:

a mounting section including an electrical connection section;

a detachable member that is mountable in the mounting section by moving in a mounting direction and removable from the mounting section by moving in a removal direction, the detachable member including:

a housing, the housing substantially encompassing an interior; and a conductive member that is connected to the housing, the conductive member moving in a contact movement direction under contact by the electrical connection section while the housing is being mounted in the mounting section and electrically connecting with the electrical connection section while the housing is mounted in the mounting section, the contact movement direction being from outside the housing toward the interior of the housing and orthogonal to the mounting direction and the removal direction.

20. The image forming device as claimed in claim 19, wherein the electrical connection section is formed with a slanted surface for guiding the detachable member while the housing is being mounted in the mounting section.

21. The image forming device as claimed in claim 19, further comprising:

a developer bearing member provided in the detachable member, the developer bearing member bearing developer;

an image bearing member that bears a developer image developed by developer from the developer bearing member;

a contact/separation unit that moves the detachable member horizontally between a contact position and a separated position, the developer bearing member being in contact with the image bearing member while the detachable member is in the contact position and separated from the image bearing member while the detachable member is in the separated position; and a bias supply member provided at the electrical connection section, the bias supply member supplying a bias; wherein the conductive member includes a first contact point that electrically connects with the bias supply member while the contact/separation unit moves the detachable member into the contact position and that does not electrically connect with the bias supply member while the contact/separation unit moves the detachable member into the separated position.

22. The image forming device as claimed in claim 19, further comprising a bias supply member provided at the electrical connection section, the bias supply member supplying a bias, the conductive member contacting the bias supply member after the conductive member moves in the contact movement direction and while the housing is mounted in the mounting section.

23. The image forming device as claimed in claim 19, further comprising a guide member that guides the detachable member while the detachable member is being mounted in or removed from the mounting section.

24. The image forming device as claimed in claim 23, further comprising a bias supply member provided at the electrical connection section, the bias supply member supplying a bias, the guide including a guide surface that the conductive member slides against while the detachable member is being mounted in or removed from the mounting section, the guide surface being disposed substantially at the same position as the bias supply member with respect to the contact movement direction.

25. The image forming device as claimed in claim 23, further comprising a bias supply member provided at the electrical connection section, the bias supply member supplying a bias, the guide including a guide surface that the conductive member slides against while the detachable member is being mounted in or removed from the mounting section, the guide surface being disposed farther than the bias supply member in the contact movement direction.

26. The image forming device as claimed in claim 19, wherein the electrical connection section includes a slide contact surface, the conductive member sliding along the slide contact surface while the detachable member is being mounted into the mounting section, and further comprising cleaning member that cleans the conductive member.

27. The developing unit of claim 17, wherein the detachable member further comprises an operation member that operates under application of a bias, wherein the conductive member includes:

a first contact point that electrically connects with a bias supply member of the electrical connection section of the image forming device while the housing is mounted in the image forming device;

a second contact point that is electrically connected with the operation member; and a connection member that connects the first contact point and the second contact point to each other, the first contact point being positioned downstream from the second contact point with respect to the mounting direction.

28. The developing unit of claim 18, wherein the detachable member further comprises an operation member that operates under application of a bias, wherein the conductive member includes:

a first contact point that electrically connects with a bias supply member of the electrical connection section of the image forming device while the housing is mounted in the image forming device;

a second contact point that is electrically connected with the operation member; and a connection member that connects the first contact point and the second contact point to each other, the first contact point being positioned downstream from the second contact point with respect to the mounting direction.

29. The developing unit of claim 19, wherein the detachable member further comprises an operation member that operates under application of a bias, wherein the conductive member includes:

a first contact point that electrically connects with a bias supply member of the electrical connection section of the image forming device while the housing is mounted in the image forming device;

a second contact point that is electrically connected with the operation member; and a connection member that connects the first contact point and the second contact point to each other, the first contact point being positioned downstream from the second contact point with respect to the mounting direction.

30. The image forming device as claimed in claim 29, further comprising:

a developer bearing member provided in the detachable member, the developer bearing member bearing developer;

an image bearing member that bears a developer image developed by developer from the developer bearing member;

a contact/separation unit that moves the detachable member horizontally between a contact position and a separated position, the developer bearing member being in contact with the image bearing member while the detachable member is in the contact position and separated from the image bearing member while the detachable member is in the separated position; and a bias supply member provided at the electrical connection section, the bias supply member supplying a bias; wherein the first contact point electrically connects with the bias supply member while the contact/separation unit moves the detachable member into the contact position and does not electrically connect with the bias supply member while the contact/separation unit moves the detachable member into the separated position.

31. A developer cartridge comprising:

a housing that accommodates a developer therein;

a developer roller including a developer roller shaft rotatably supported by the housing and conductive member provided with the housing, the conductive member being electrically connected to the developer roller shaft and being movable between a first position and a second position.

32. The developer cartridge according to claim 31, wherein the conductive member includes:

a first contact member;

a second contact member that is electrically connected with the developer roller shaft; and a connection member that connects the first contact member with the second contact member, the first contact member being movable between the first position and the second position.

33. The developer cartridge according to claim 32, wherein the connection member has a resilience.

34. The developer cartridge according to claim 33, wherein the connection member is formed of metal.

35. The developer cartridge according to claim 32, wherein the connection member generates an urging force that urges the first contact member into the first position.

36. The developer cartridge according to claim 35, wherein the first contact member is a separate member from the connection member.

37. The developer cartridge according to claim 35, wherein the second contact member is integrally formed with connection member.

38. The developer cartridge according to claim 32, wherein the first contact member is provided on a surface of the housing, and where the first contact member is provided is different from where the developer roller shaft is supported.

39. An image forming apparatus comprising:

a main casing; and a cartridge detachably mountable to the main casing, wherein the cartridge further comprises:

a housing that accomodates a developer therein;

a developer including a developer roller shaft rotatably supported by the housing; and a conductive member provided with the housing, the conductive member being electrically connected to the developer roller shaft and being movable between an first position and a second position.

40. The image forming apparatus according to claim 39, wherein the conductive member is positioned at the second position when the cartridge is mounted to the main casing.

41. The image forming apparatus according to claim 40, wherein the conductive member includes:

a first contact member;

a second contact member that is electrically connected with the developer roller shaft; and a connection member that connects the first contact member with the second contact member, the first contact member being positioned at the second position when the cartridge is mounted to the main casing.

42. The image forming apparatus according to claim 41, wherein the connection member generates an urging force that urges the first contact member into the first position.

43. The image forming apparatus according to claim 39, further comprising:

an electrode electrically connected to a power source, wherein the conductive member contacts the electrode when the cartridge is mounted to the main casing.

44. The image forming apparatus according to claim 43, wherein the conductive member includes:

a first contact member;

a second contact member that is electrically connected with the developer roller shaft; and a connection member that connects the first contact member with the second contact member, the first contact member contacting the electrode when the cartridge is mounted to the main casing.

45. The image forming apparatus according to claim 44, wherein the first contact is provided on a surface of the housing, and where the first contact member is provided is different from where the developer roller shaft is supported.

* * * * *

UNITED STATES PATENT AND TRADEMARK OFFICE

CERTIFICATE OF CORRECTION

PATENT NO. : 7,079,783 B2
APPLICATION NO. : 10/627624
DATED : July 18, 2006
INVENTOR(S) : Katsuyuki Yokoi It is certified that error appears in the above-identified patent and that said Letters Patent is hereby corrected as shown below:

Col. 21, In claim 28 line 56, delete "The developing unit of claim 18" and replace it with --The process unit of claim 18--.

Col. 22, In claim 29, line 4, delete "The developing unit of claim 19" and replace it with --The image forming device of claim 19--.

Signed and Sealed this

Twenty-fourth Day of April, 2007

JON W. DUDAS
*Director of the United States Patent and Trademark Office*